United States Patent [19]

Miller

[11] 4,289,290

[45] * Sep. 15, 1981

[54] UNIVERSAL DRAWER SLIDE MOUNTING BRACKET

[75] Inventor: Calvin K. Miller, Grand Rapids, Mich.

[73] Assignee: Knape & Vogt Manufacturing Co., Grand Rapids, Mich.

[ * ] Notice: The portion of the term of this patent subsequent to Feb. 27, 1996, has been disclaimed.

[21] Appl. No.: 6,454

[22] Filed: Jan. 25, 1979

Related U.S. Application Data

[63] Continuation-in-part of Ser. No. 850,407, Nov. 10, 1977, Pat. No. 4,141,525.

[51] Int. Cl.[3] ..... A47B 88/00

[52] U.S. Cl. ..... 248/251; 312/334

[58] Field of Search ..... 248/251, 262, DIG. 9, 248/300; 312/334, 335, 343, 342, 348, 330 R

[56] References Cited

U.S. PATENT DOCUMENTS

| | | | |
|---|---|---|---|
| 1,352,652 | 9/1920 | Boye | 248/262 |
| 2,202,209 | 5/1940 | Kennedy | 312/344 X |
| 2,638,643 | 5/1953 | Olson | 248/300 X |
| 3,139,313 | 6/1964 | Rule | 312/348 X |
| 3,149,811 | 9/1964 | Fremstad et al. | 248/251 |
| 3,675,883 | 7/1972 | Holmes | 248/251 |
| 3,784,274 | 1/1974 | Holmes | 312/348 X |
| 3,980,365 | 9/1976 | MacDonald | 312/348 X |
| 4,061,375 | 12/1977 | Mertes | 312/348 X |

*Primary Examiner*—J. Franklin Foss

*Attorney, Agent, or Firm*—Price, Heneveld, Huizenga & Cooper

[57] ABSTRACT

An omni orientation mounting bracket for multiple positioning use with a drawer rail assembly, being a unitary member composed of a channel sleeve integral with an orificed mount plate along a linear juncture, the mount plate having a plurality of bend loci formed by aligned orifices, formable along said bend loci in a multiple of directions, with an integral spring clip offset laterally and projecting forwardly of the channel sleeve to receive and retain the mounting rail.

2 Claims, 7 Drawing Figures

UNIVERSAL DRAWER SLIDE MOUNTING BRACKET

RELATED APPLICATION

This application is a continuation-in-part application of my copending application Ser. No. 850,407 filed Nov. 10, 1977 and entitled UNIVERSAL DRAWER SLIDE MOUNTING BRACKET now U.S. Pat. No. 4,141,525.

BACKGROUND OF THE INVENTION

This invention relates to mounting brackets for drawer rail assemblies. Mounting brackets for attaching drawer rails to cabinets or other structures presently exist in a variety of sizes, styles, and configurations. Because cabinets are variously structured, an assortment of mounting brackets is marketed, of left and right-hand type, some for back mounting, some for bottom mounting, some for top mounting, and some for side mounting.

SUMMARY OF THE INVENTION

The mounting bracket of this invention is itself capable of back mounting, bottom mounting, top mounting, or side mounting, right or left-hand, yet produced on mass production basis on progressive dies. The rail supporting mount plate component of the bracket, integral with the drawer rail receiving channel sleeve, has a plurality of elongated linear bend loci, one being on the juncture between the mount plate and the channel sleeve, and the others transverse thereto. The back panel of the channel sleeve has a laterally projecting spring clip defining a receiving slot between it and said channel back panel, with a mouth oriented forwardly, to receive and retain a cabinet rail.

DESCRIPTION OF THE PREFERRED EMBODIMENT

Figure 3:
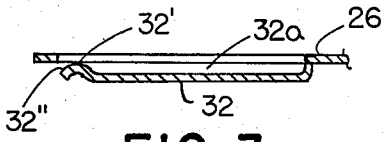
FIG. 3 is a sectional view of a portion of the bracket in FIG. 1, taken on plane A—A.
Figure 2:
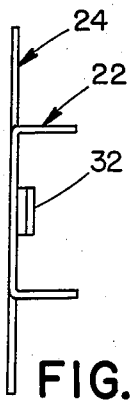
FIG. 2 is an end elevational view of the bracket in FIG. 1.

The novel bracket 10 is primarily intended as a rear mounting bracket for a mounting rail or channel 12 of a conventional drawer rail assembly. Since such conventional drawer rail assemblies assume a variety of forms, the details of a particular assembly are not set forth but rather only the mounting channel portion thereof for illustrative purposes. Such a channel or rail is U-shaped or C-shaped in cross section, with a vertical back panel 14 and a pair of upper and lower flanges 16 and 16', there being appropriate orifices 18 along the length thereof for attachment to the cabinet (not shown) and optional front plate and roller structure 20 cooperative with the drawer rail or the drawer itself (not shown). The novel bracket 10 is intended primarily to support the rear end of the mounting rail 12 of the drawer rail assembly.

Figure 7:
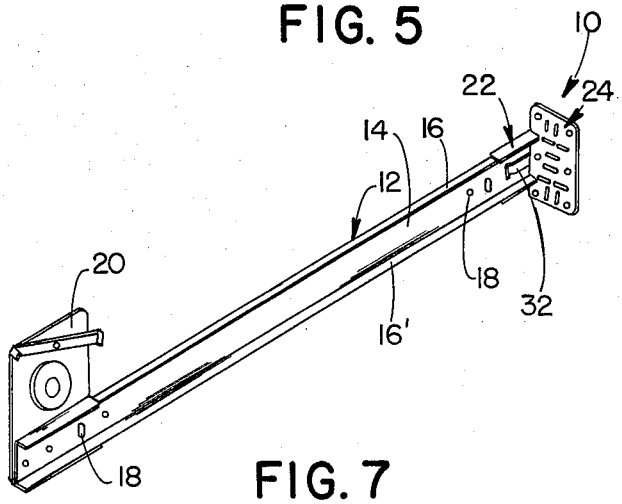
FIG. 7 is a perspective view of the novel bracket shown in a typical combination with the mounting channel rail of a drawer rail assembly.

This bracket 10 is a unitary member formed of components 22 and 24 integrally connected with each other along a linear juncture, and a spring clip 32 integral with and projecting from component 22. More specifically, the bracket includes a drawer rail support in the form of a channel sleeve 22 and an orificed mount plate 24. Channel sleeve 22 has a back panel 26 and a pair of spaced upper and lower side panels 28 and 30 parallel to each other and transverse to back panel 26, normally perpendicular thereto. Sleeve 22 has an open end on the opposite end as component 24. Back panel 26 includes an integral spring clip or tang 32 severed from the panel on three edges. The clip projects into the space defined by the sleeve, being integrally connected to back panel 14 of the drawer channel 12 at the rear end or edge of the clip, i.e. nearest member 24, and projecting forwardly, i.e. away from member 24, spaced from back panel 14 to form a receiving slot **32*a* therebetween. This slot receives the back panel 14 of the mounting channel (FIG. 7). The free end 32' of clip 32 adjacent the mouth of the slot has a bend forming an abutment surface protruding back to the gap in the back panel from which the clip was punched, so that clip 32 is forced against an inherent bias away from back panel 26 when the mounting channel panel 14 is inserted between this abutment surface and the inside face of panel 26. The very forward end of the clip is flared away from back panel 26 to form a mouth 32''**. The resulting lateral pressure on the drawer rail channel frictionally takes up any slack between the members for eliminating rattle and also to retain the rear end of the mounting channel.

Figure 5:
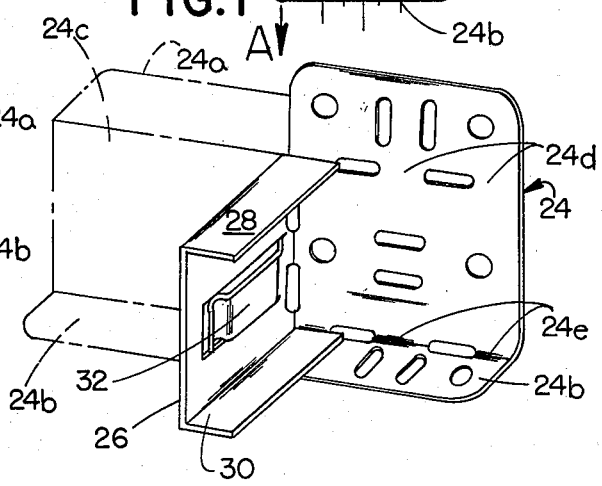
FIG. 5 is a perspective view of the bracket in FIG. 1 shown in another orientation for bottom mounting, and also showing alternate orientations in phantom lines.

Mount plate 24 in its initial form is a planar member having a series of orifices therein, some of which are elongated as at **36*a* and some of which may not be elongated as at 36*b*. These orifices are placed in a plurality of positions over the surface of the mount plate to allow highly selective use thereof for attachment by suitable fasteners such as screws or tacks to the cabinet structure within which the bracket is placed. Importantly, some of the orifices are placed in alignment with each other from one edge of the unit to the opposite edge to allow multiple direction orientation of portions of the mount plate. These plurality of orifices effect elongated linear bend loci. One of these elongated bend loci is at the integral juncture between the mount plate and the sleeve. Specifically, elongated spaced orifices 36*c* are linearly aligned with each other and along the linear juncture of the mount plate and sleeve, leaving a series of linearly aligned, spaced isthmuses 38 along the juncture. These collectively form a bend line between mount plate 24 and sleeve 22 to enable the plate to be readily changed in its orientation relative to the sleeve, typically normal thereto, to a position shown in solid lines in FIG. 5 for example, or alternately in the opposite direction as shown in phantom lines in FIG. 5. The unit can be a left-hand or right-hand mounting bracket for either side of the drawer structure. The function of the elongated orifices 36*c* at this bend line can optionally be assisted by a crease formed into the material across the isthmuses 38**.

Figure 6:
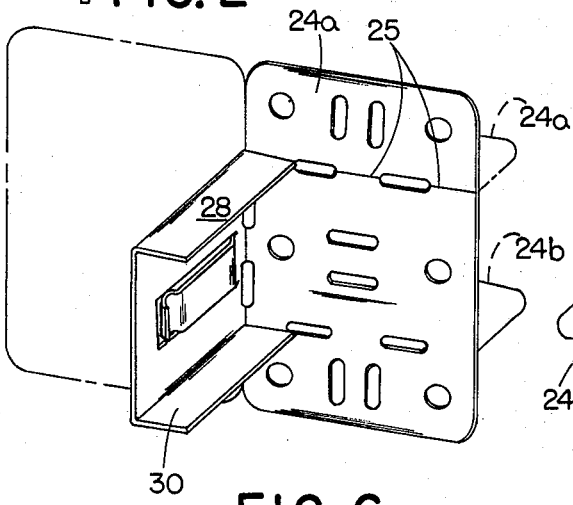
FIG. 6 is a perspective view of the bracket in FIG. 1 oriented for back mounting, and showing alternate configurations in phantom lines.
Figure 4:
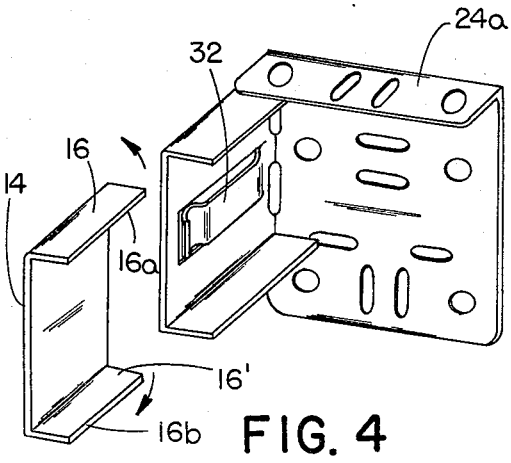
FIG. 4 is an exploded perspective view of the bracket in FIGS. 1–3 with a portion of a drawer rail channel, the bracket being configurated to an orientation for top mounting.

In addition to the bend line formed at this juncture, there are preferably two additional bend lines normal to the juncture bend line, and parallel to each other, extending from one peripheral edge of the mount plate to the opposite edge. More specifically, the upper and lower portions or the mount plate extend normal to the elongated dimension of sleeve 22, beyond side panels 28 and 30 of the sleeve, to form mounting flange portions 24*a* and 24*b*. These mounting flange portions are integral with the remaining portions of the bracket but are readily oriented into a desired position transverse to central portion 24*c* of the plate, by being joined to the central portion by isthmuses spaced by elongated orifices to form bend loci. Particularly, flange portion 24*a* is joined to the central portion of the plate by isthmuses 24*d* spaced by aligned orifices 40. Likewise, flange portion 24*b* is integrally interconnected with central portion 24*c* by isthmuses 24*e* spaced by elongated aligned orifices 42. The sets of aligned orifices 40 and 42 thus respectively form two elongated linear bend lines to allow the flange portions 24*a* and 24*b* to be reoriented transverse to the direction of the central plate member, i.e. rearwardly as shown by the phantom lines in FIG. 6, forwardly as shown by flange 24*b* in FIG. 5 and flange 24*a* in FIG. 4, or alternately one rearward and one forward as depicted in phantom lines in FIG. 5. As illustratively shown by phantom lines at 25 in FIG. 6 relative to upper flange 24*a*, one or more of these bend lines can include creases or indentations to further facilitate reorientation of the plate portions if desired.

Figure 1:
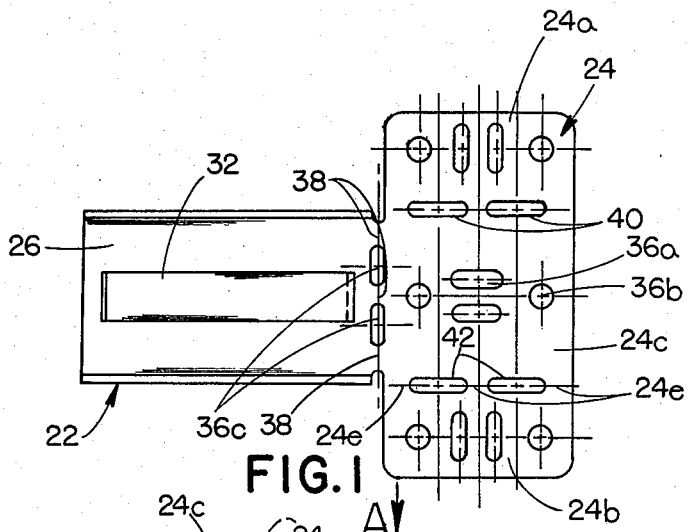
FIG. 1 is a side elevational view of the novel bracket.

As will be readily apparent from the drawings and the above description, selected portions of the novel bracket can be readily oriented for side mounting (FIG. 1), back mounting (solid lines in FIG. 6), bottom mounting (solid lines in FIG. 5), top mounting (solid lines in FIG. 4), and left or right-hand arrangement to accommodate left or right-hand drawer rails, being omni positional, yet simple in structure and capable of being formed of one piece by high speed production techniques, preferably with progressive dies.

Once the bracket is so mounted, the open end of the sleeve readily receives the inserted rear end of the mounting rail, the back panel of the mounting rail being slid into the mouth 32″ and the slot formed between the biasing clip 34 and back panel 26 of channel 22, and being retained by the bias of the clip which is laterally deflected by the entering rail.

Certain additional advantages and arrangements of the bracket will be readily apparent to those in the art upon studying the foregoing disclosure.

The embodiments of the invention in which an exclusive property or privilege is claimed are defined as follows.

1. An omni orientation mounting bracket for selective multiple position use to support a drawer rail assembly, comprising:

a one piece bracket having a channel sleeve to interfit with a drawer rail, and a mount plate for cabinet attachment; said channel sleeve having a back panel and a pair of side panels transverse to said back panel, said panels forming an open front end to receive a mounting rail in said channel sleeve; said mount plate being integrally joined with said channel sleeve at said back panel along a linear juncture, and having a plurality of peripheral edges; said mount plate having plate portions and at least two bend lines, one of which bend lines is along said linear juncture and the other of said bend lines between said plate portions to allow said mount plate portions to be positioned in selected orientation relative to said channel sleeve; said bend lines having aligned spaced orifices and isthmuses therealong; and a spring clip projecting from said back panel into said channel sleeve with one end of said spring clip being integral with said back panel and the remainder thereof projecting toward said open end to form a slot between said spring clip and said back panel.

2. The bracket in claim 1 wherein said spring clip has a free front end portion protruding laterally toward said back panel and an adjacent mouth to said slot whereby entry of a channel rail shifts said clip against an inherent bias.

* * * * *